United States Patent [19]

Feldmann et al.

[11] Patent Number: 5,000,023

[45] Date of Patent: Mar. 19, 1991

[54] OPERATING METHOD AND ROLLING MILL TRAIN FOR CONTINUOUSLY ROLLING A PROFILED BILLET TO A PREDETERMINED FINISHED CROSS-SECTIONAL SHAPE OF ACCURATE SIZE

[75] Inventors: Hugo Feldmann, Alsdorf-Warden; Günter Kirchmann, Ratingen; Hubert Müller, Grevenbroich; Paul Kreisel, Erkrath, all of Fed. Rep. of Germany

[73] Assignee: SMS Schloemann-Siemag Aktiengesellschaft, Dusseldorf, Fed. Rep. of Germany

[21] Appl. No.: 348,566

[22] Filed: May 5, 1989

[30] Foreign Application Priority Data

May 5, 1988 [DE] Fed. Rep. of Germany ..... 3815312

[51] Int. Cl.[5] ..... B21B 13/12

[52] U.S. Cl. ..... 72/235; 72/245; 72/249

[58] Field of Search ..... 72/205, 235, 237, 238, 72/245, 249

[56] References Cited

U.S. PATENT DOCUMENTS

| | | | |
|---|---|---|---|
| 3,043,170 | 7/1962 | Wales | 72/235 |
| 3,646,795 | 3/1972 | Hinterholzl | 72/238 |
| 3,756,060 | 9/1973 | Bindernagel | 72/235 |
| 3,786,664 | 1/1974 | Jones et al. | 72/238 |
| 4,531,394 | 7/1985 | Turley et al. | 72/238 |

FOREIGN PATENT DOCUMENTS

| | | | |
|---|---|---|---|
| 207502 | 3/1984 | Fed. Rep. of Germany | 72/235 |
| 53-14149 | 2/1978 | Japan | 72/235 |
| 53-78963 | 7/1978 | Japan | 72/235 |
| 55-122623 | 9/1980 | Japan | 72/235 |
| 58-135707 | 8/1983 | Japan | 72/235 |
| 59-50905 | 3/1984 | Japan | 72/237 |
| 61-229403 | 10/1986 | Japan | 72/235 |
| 1217927 | 1/1971 | United Kingdom | 72/235 |

*Primary Examiner*—Lowell A. Larson
*Assistant Examiner*—Thomas C. Schoeffler
*Attorney, Agent, or Firm*—Toren, McGeady & Associates

[57] ABSTRACT

An operating method and a rolling mill train for continually rolling a profiled billet to a predetermined finished cross-sectional shape of accurate dimensions by means of successively arranged rolling mill stands with pairs of rolls, wherein the axes of the pairs of rolls extend perpendicularly to each other. The pairs of rolls have oppositely located pass screws which determine the cross-sectional shape of the rolled steel section billet which travels through the pairs of rolls. The billet is sized in one or more roughing stands locally in a circumferential portion of the cross-section thereof which, after leaving the last roughing stand, runs in the subsequent main stand into the region of a contact line of the two rolls of the main stand, such that the entire material of the billet running into the main stand completely fills out the pass of the main stand without significantly deforming the region of the contact line of the two rolls of the main stand.

12 Claims, 6 Drawing Sheets

1
1b
4
3
5
2
W
1b
1
38
8
18a
39
A
12
11
10
7
9
6

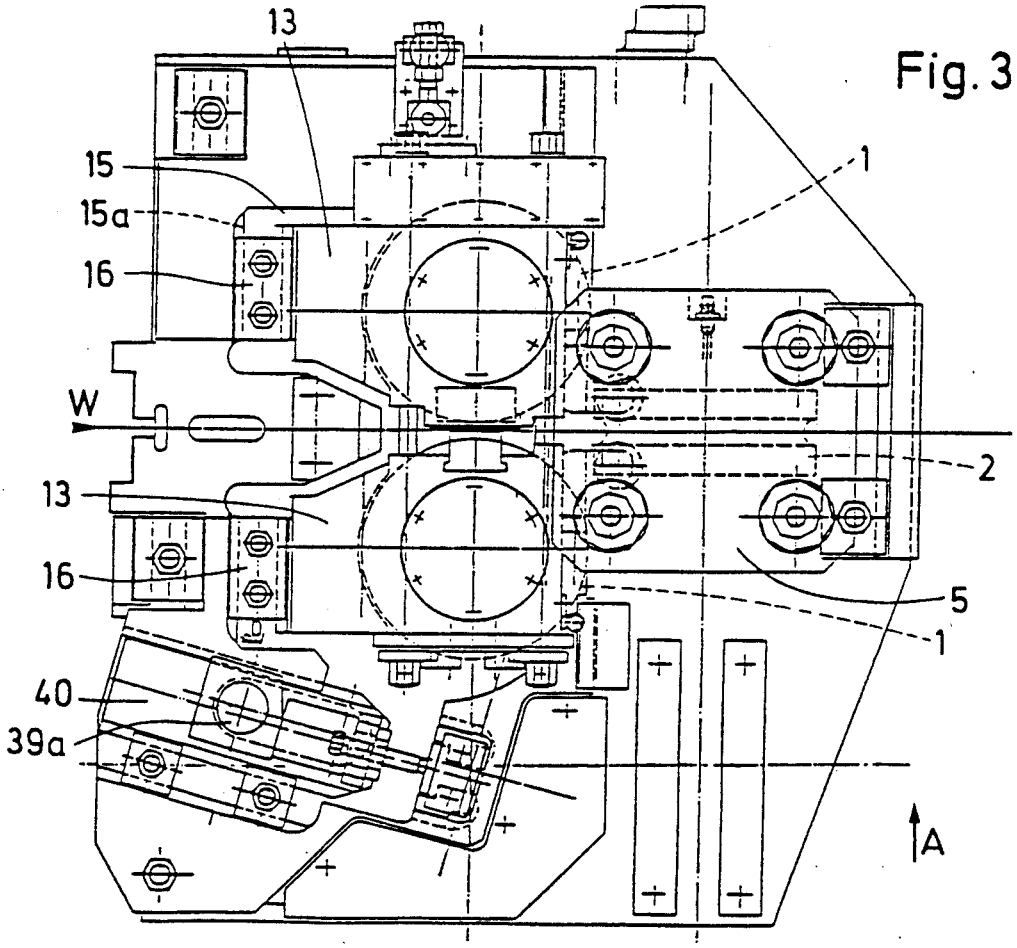
Fig. 3
Fig. 4
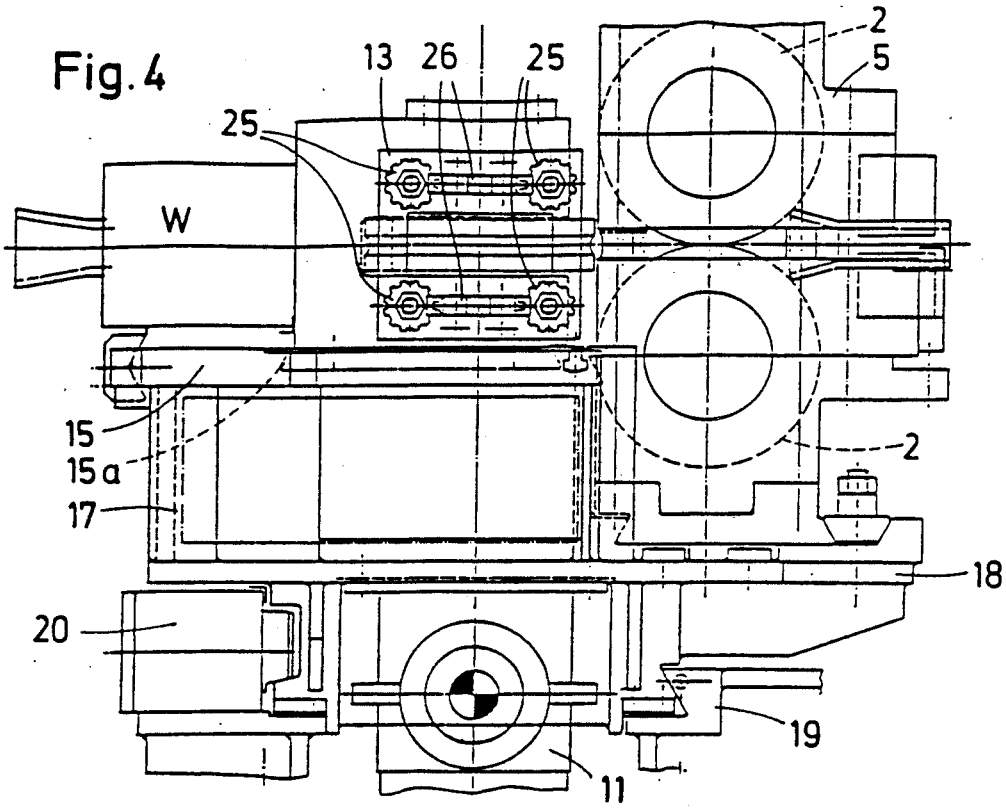

OPERATING METHOD AND ROLLING MILL TRAIN FOR CONTINUOUSLY ROLLING A PROFILED BILLET TO A PREDETERMINED FINISHED CROSS-SECTIONAL SHAPE OF ACCURATE SIZE

BACKGROUND OF THE INVENTION

1. Field of the Invention

The present invention relates to an operating method for continuously rolling a profiled billet to a predetermined finished cross-sectional shape of accurate dimension by means of successively arranged rolling mill stands with pairs of rolls, wherein the axes of the pairs of rolls extend perpendicularly to each other. The pairs of rolls have oppositely located pass grooves which determine the cross-sectional shape of the rolled steel section billet which travels through the pairs of rolls.

The present invention further relates to a rolling mill train for carrying out the above-described operating method.

2. Description of the Related Art

A billet emerging from a continuous rolling mill train having a diameter of, for example, approximately 10 to 25 mm, usually has tolerance deviations of ±0.5 mm. However, when cross-sectional shapes of accurate size are to be rolled, the tolerance deviations should only be 0.05 mm and less.

Moreover, the billet is subjected to temperature variations over its length. Because of other influences, such as, material quality, pulling and twisting between the rolling mill stands of the rolling mill train, etc., the billet emerging from the last rolling mill stand has a cross-section whose shape and behavior for further rolling cannot be exactly predetermined. This results in difficulties leading to a number of disadvantages even when rolling, for example, with a pair of rolls which form a positionally accurate, closed or box pass, wherein the preloading force or initial tension substantially exceeds the rolling force.

In the past, it was assumed that it was not possible to influence the negative properties of the billet resulting from the rolling procedure in the rolling mill train, particularly with respect to the cross-sectional shape of the billet. These difficulties are, for example, that it is not possible by controlling adjustment to change the box passes formed by the pairs of rolls. As a result, the pass may frequently not be filled completely or may be excessively filled because of the changing shape of the cross-section or because of changing material behavior, for example, due to temperature changes of the billet emerging from the rolling mill train. It has been possible to eliminate this difficulty more or less satisfactorily by using several successively arranged pairs of rolls with passes of stepped down size.

Another difficulty was the disadvantageous formation of partial, more or less strong edge fins at the circumference of the section after it emerged from the last finishing stand. It has up to now not been possible to eliminate or avoid this difficulty even with the use of several specifically arranged pairs of rolls in the above-described manner. Also, it has not been possible in the past to eliminate the disadvantages which result from the twisting tendency of the billet and the pulling between the successively arranged pairs of rolls. Finally, it has not been possible in the past to provide a shaping of the billet in the above-described type of rolling in such a way that the billet has over its entire length a uniform finished cross-sectional shape.

It is, therefore, the primary object of the present invention to improve the operating method mentioned above in such a way that the above-described difficulties and disadvantages are avoided or eliminated. In addition, a suitable arrangement for carrying out this operating method is to be provided.

In order to meet the above objects, the present invention starts from the finding that a uniform formation of the cross-sectional shape and of the structure of the billet emerging from the rolling mill train is effected by as uniform a distribution as possible of the reductions, i.e., a small increase in width and a uniform structure compacting, and by a uniform guidance of the rolling temperatures over the length of a billet and of the cross-section thereof. In rolling, the deformation occurs as a decrease in height caused by the passage of the billet through the pass. This decrease in height results in an increase of the length and an increase of the width of the billet. In rolling, the increase in length is primarily desired. The increase in width usually is a less desired result. Those cross-sectional portions which during this procedure are spread laterally, are subjected to very little or no decrease in height and, thus, are not elongated or unsatisfactorily elongated. The laterally spread portions whose height is only insignificantly decreased are taken along because of the connection between the individual cross-sectional portions and are stretched by the occurring tensional forces. The laterally spread edge portions are subjected to the danger of corner cracks. When such a lateral spreading occurs, this requires in the next rolling pass an appropriate decrease in height and, thus, increased rolling forces, increased deforming moments and an increased application power. However, the lateral spreading not only requires increased power, but it is also necessary either to have greater decreases per each rolling pass or a greater number of successively acting rolling passes must be provided.

Accordingly, in order to improve the above-described operating method, it is necessary to find a rolling deformation in which as little lateral spreading as possible occurs. The magnitude of the lateral spreading is influenced by the temperature of the rolled material, the frictional behavior between rolls and rolled material, the rolling speed, the pass shape and the roll diameters. In an operating method of this type, the temperature of the rolled material is predetermined by the rolling mill train and cannot be influenced. The frictional behavior between roll and rolled material can be advantageously influenced by an appropriate construction of the surfaces. The rolling speed is also predetermined by the rolling mill train. The pass shape is to be such that lateral spreading is essentially avoided and a reduction as uniform as possible over the width of the rolled material is achieved.

Of the above-described factors, the roll diameter is the easiest influenced in the operating method under discussion. Therefore, the diameter should be kept as small as possible, so that lateral spreading is also small and with uniform decrease in height the number of passes to be passed becomes smaller and the deformation resistance becomes smaller. Moreover, smaller rolling forces and smaller torques occur, so that the drive power may also be smaller. Furthermore, the tendency to lateral spreading is kept low, the roll wear is reduced and the desired narrow tolerances can be better maintained. It is also important that favorable deformation conditions are created in the rolling pass and that the surface of the rolled material is improved because of the short distances of contact between roll and rolled material.

SUMMARY OF THE INVENTION

In accordance with the present invention, the above-described object is met by sizing the billet in one or more roughing stands locally in that circumferential portion of the cross-section which, after leaving the last roughing stand, runs in the subsequent main stand into the region of the contact line of the two rolls of this main stand, such that the entire material of the billet running into the main stand completely fills out the pass of this main stand without significantly deforming the pitch line contact area.

The rate of rotation of the pairs of rolls of the main stand can be adjusted in dependence upon the rate of rotation of the rolls of the last roughing stand by applying a very light pull on the billet. Moreover, the rate of rotation of the rolls of the roughing stand can be controlled by permitting a slight slip between the rolls and the billet.

Moreover, in accordance with the present invention, a rolling mill train for carrying out the operating method described above includes at least two successive sizing mill stands in which the rolls of the pairs of rolls can be positioned relative to each other with a preloading force which substantially exceeds the rolling force, wherein the geometric shape of the circumferential lines of the passes formed in the upstream sizing mill stands corresponds at least in the wall portion of the bottom of both pass grooves, and in the downstream sizing mill stands essentially in the entire wall portion of both pass grooves, with the geometric shape of the circumferential line of the predetermined finished cross-sectional shape of the billet.

In accordance with an advantageous feature of the present invention, the distance between the centers of the bottom portions of the passes of the upstream sizing mill stands is slightly smaller than or equal to the predetermined finished diameter of the cross-sectional shape formed in this region. Moreover, at least the rolls of the pairs of rolls of the downstream sizing mill stand has circumferential portions which are known per se, which are located laterally outside of the pass grooves, which rest on each other during rolling and which are pressed against each other with the preloading force.

The rolls of the pairs of rolls may be adjustable away from each other against the preloading force within an elastic portion of the circumferential portions which rest against each other. The adjustment may be made by controlling the relative positions and distances. The pass grooves have border edges which advantageously are rounded off, so that a slight laterally outwardly directed symmetrical recess is formed in the circumferential line of the pass. The rounded-off portion may be circular. The radius of the circular rounded-off portion may be, for example, 1 to 2 mm. The wall portion of the bottom of the pass grooves which coincides with the geometrical shape of the circumferential line of the predetermined finished cross-sectional shape of the billet is dimensioned in such a way that it covers the portion of the symmetrical recess of the circumferential line of the pass of the downstream sizing mill stand.

The above-explained sizing mill stands can also be arranged in a rolling mill train instead of the roughing stand section, the intermediate stand section and/or the finishing stand section of this rolling mill train. For rolling a predetermined intermediate cross-sectional shape, it is also possible to arrange such sizing mill stands within the successive rolling mill stands of a rolling mill train. One of the pairs of rolls can also be supported by back-up rolls and the drive can be effected directly or through these back-up rolls. The pairs of rolls can also be carried by the back-up rolls or they may be radially and/or guided by the back-up rolls. Moreover, the preloading force can be transmitted from the back-up rolls to the pairs of rolls. It is also possible to provide two back-up rolls for supporting each of the rolls of the pairs of rolls.

In a rolling mill train which includes a first finishing train of independent, successively arranged rolling mill stands and a second finishing train arranged downstream of the first finishing train with a plurality of rolling mill stands combined in a finishing block, the roughing passes and the pairs of rolls forming the box passes may be arranged following the first finishing train without using the second finishing train, or between the first and the second finishing trains, or following the second finishing train.

In accordance with another feature of the present invention, the ratio of the diameters of the rolls forming the roughing pass and of the rolls of the last rolling mill stand of the rolling mill train which continuously supplies the billet may be 0.7 or smaller. The diameters of the pairs of rolls forming the roughing pass and the box pass may be approximately equal. The rolls may be rolling disks with a diameter of approximately 250 mm or less. If the rolls have this diameter and if the distance between the common planes of the axes of the pairs of rolls forming the roughing pass and of the pairs of rolls forming the box pass corresponds approximately to the sum of the diameter halves of both pairs of rolls, the resulting distance between the two passes is so small that temperature changes or twisting tendencies which would influence the billet cannot occur or occur only to an extent which can hardly be measured. The pair of rolls forming the roughing pass may be supported in bearing members which are connected to each other by means of adjustable draw spindles and which are supported against the tensioning force of these draw spindles by means of pistons to which pressure medium can be admitted and by replaceable stop members of different height which can be placed against the pistons. This arrangement makes it possible to adjust the rolls of the pair of rolls forming the roughing pass extremely accurately with very small adjusting distances against the tension force exerted by the draw spindles which acts as the preloading force, within the elastic range of the draw spindles by exactly metered changes of the pressure medium acting on the pistons. In practical use, it has been found that adjustment distances of 0.01 mm and less are possible. This accurate adjustment makes it possible to quickly and accurately adapt the roughing pass within few test passes. Subsequent adjustments during the passage of the rolled material under rolling pressure are also possible.

When the operating method according to the present invention is carried out with the use of the rolling mill train of the present invention, the cross-sectional shape of the billet is deformed in the roughing mill stand and in the immediately subsequently arranged main rolling stand in a way which resembles the deformation of a billet in the pass of a drawing die. The obtained results also correspond to some extent to those which can be obtained by drawing billets. Thus, the reduction may be surprisingly great up to 10 to 15%. In addition, a billet is formed whose finished shape, in round as well as quadratic cross-sections, only slightly deviates from the predetermined intended values and which particularly maintains this cross-sectional shape over the entire length of the rod.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 3 is a view, on a larger scale, of a detail of FIG. 2;

FIG. 4 is a side view of the detail shown in FIG. 3;

DESCRIPTION OF THE PREFERRED EMBODIMENT

Figure 1:
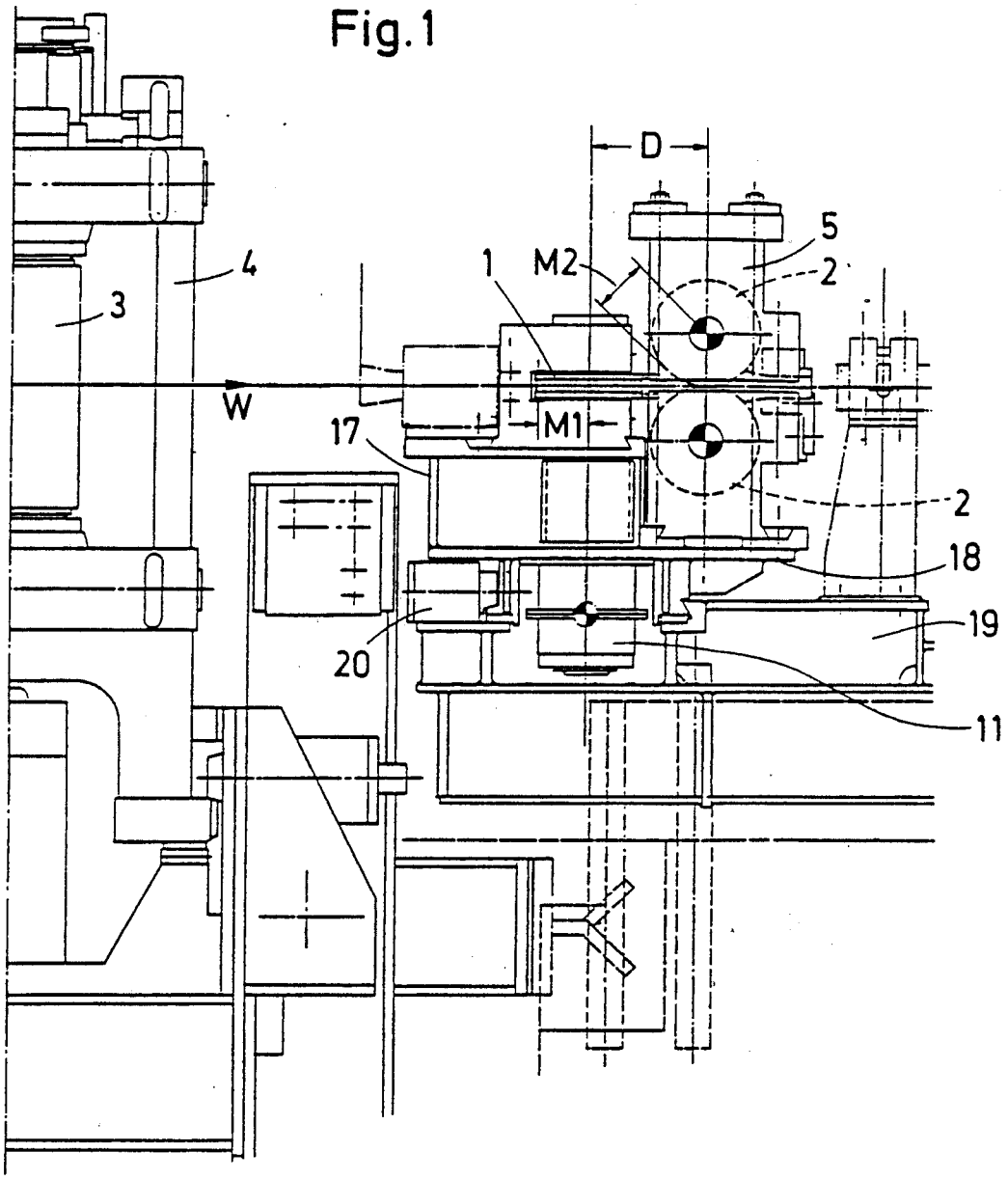
FIG. 1 is a schematic side view of the arrangement according to the present invention.
Figure 2:
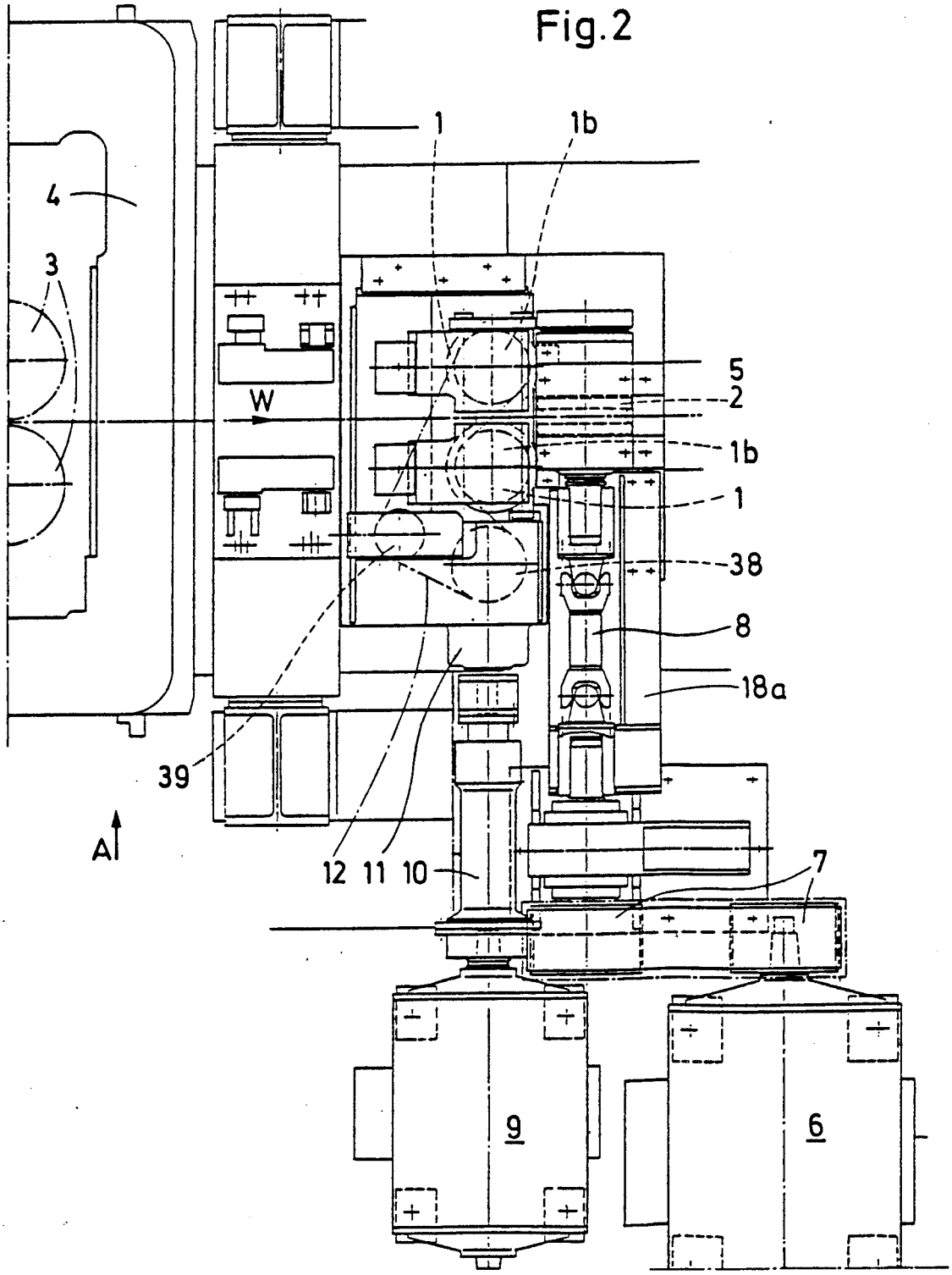
FIG. 2 is a top view of the arrangement of FIG. 1.

As illustrated in FIGS. 1 and 2 of the drawing, a pair of vertical rolls 1 forming an open roughing pass and a pair of horizontal rolls 2 forming a box pass are arranged closely one behind the other in the direction of the line of movement of the material to be rolled as indicated by an arrow W. As can be seen in FIG. 1, the distance D between the two common planes of the axes of the pairs of rolls 1 and 2 is slightly greater than the sum of the two diameter halves M1 and M2 of the rolls of the two pairs of rolls 1 and 2.

The arrangement according to the present invention is located following a pair of vertical rolls indicated by reference numeral 3 of a last stand 4 of a continuous section rolling mill train, not shown. The profiled billet is moved out of the stand 4 in the direction of the line of movement W and into the arrangement according to the invention.

The pair of horizontal rolls is supported in a tensioned rolling mill stand 5 which does not form part of the present invention. The rolling mill stand 5 tensions the rolls of the pair of horizontal rolls 2 toward each other with a preloading force which substantially exceeds the expected rolling force. The horizontal rolls 2 are driven by a motor 6 through intermediate gears 7 and joint spindles 8. The vertical rolls 1 are driven by a motor 9 through a joint spindle 10 and an angular gear unit 11 by means of a toothed belt 12 in a manner to be described below.

Figure 5:
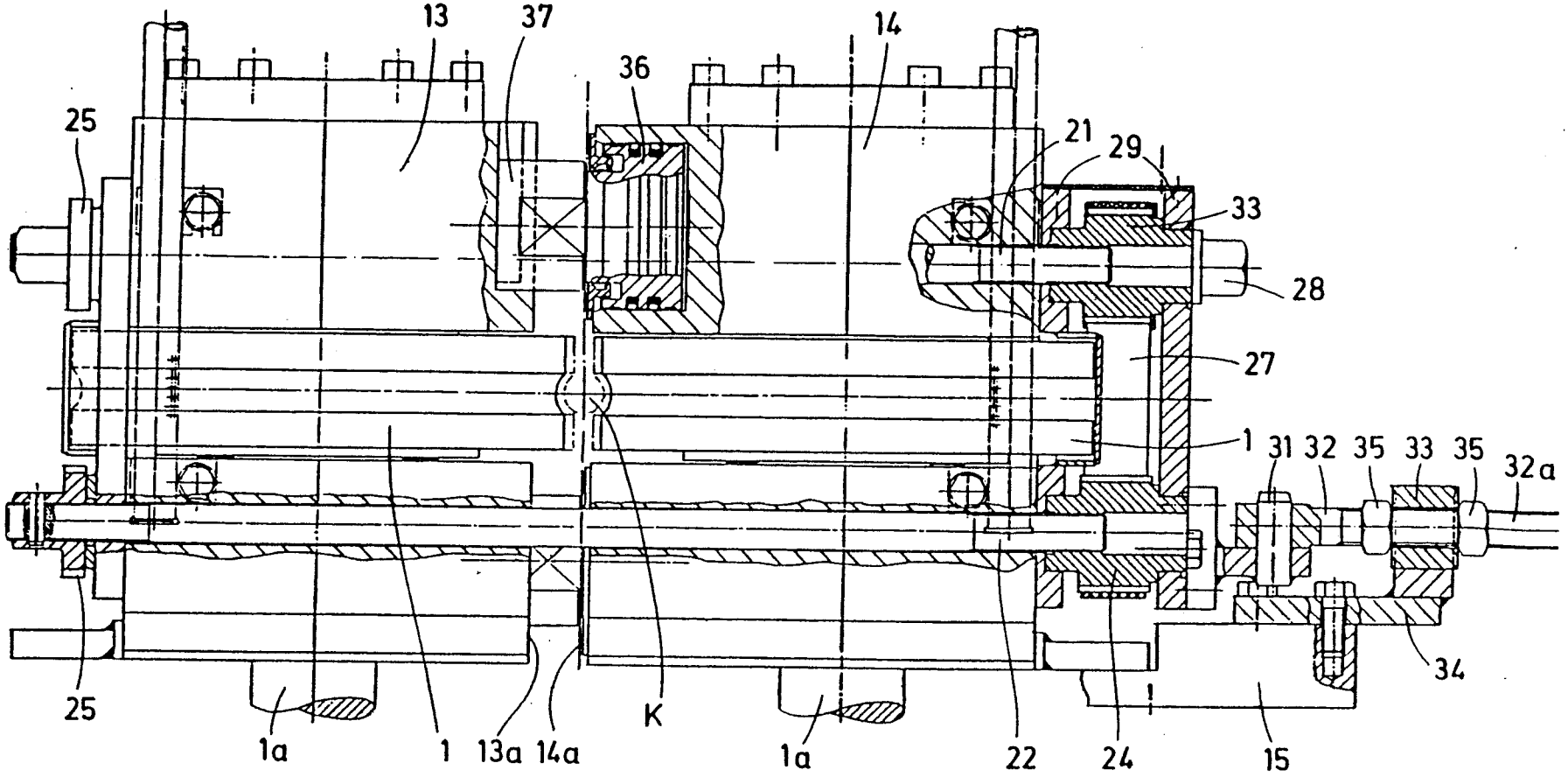
FIG. 5 is another side view, partially in section, and on a larger scale, of the detail of FIG. 3.
Figure 6:
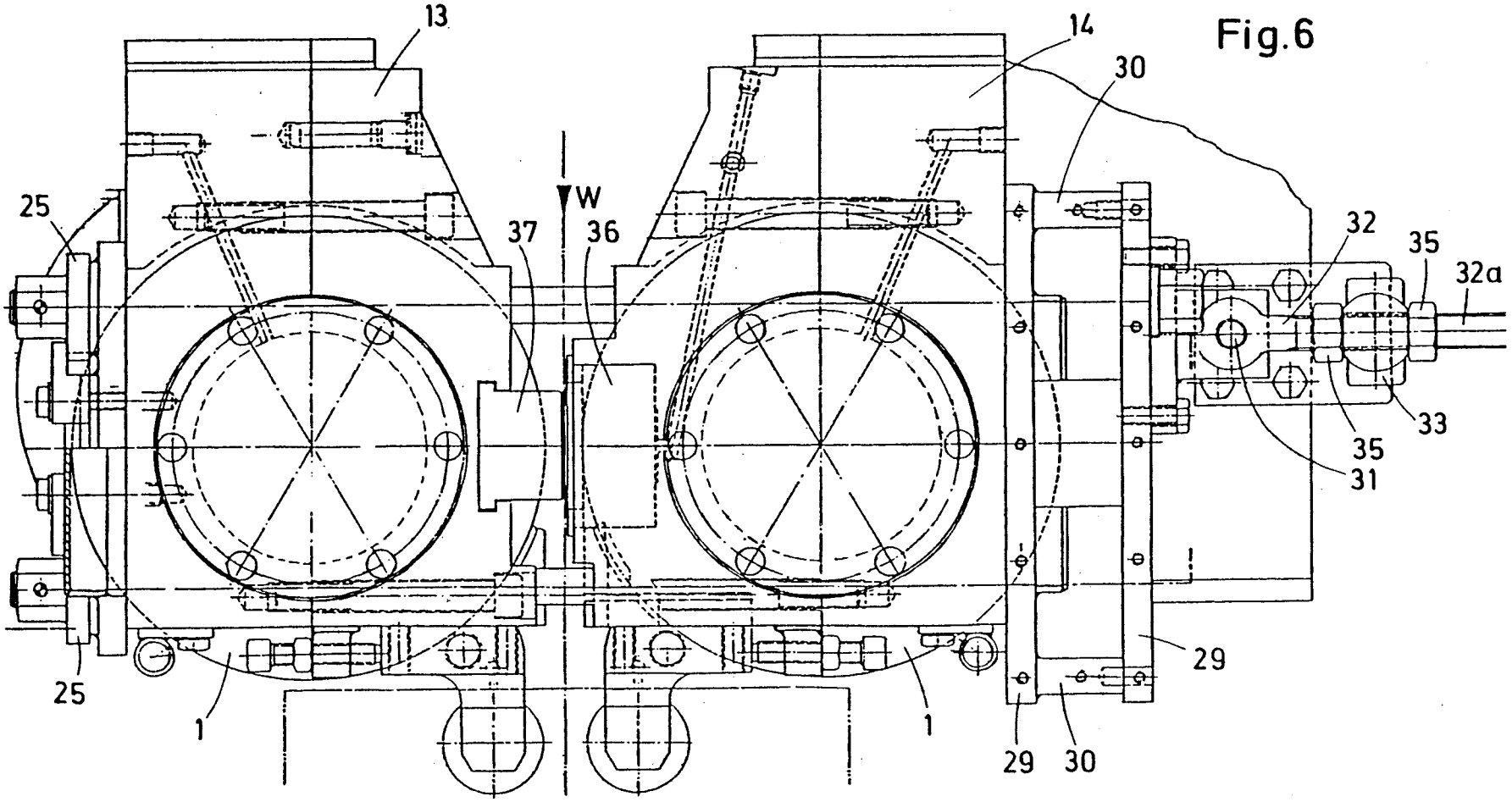
FIG. 6 is a top view of the detail shown in FIG. 5.

As is clear from FIGS. 3 and 4 as well as FIGS. 5 and 6, the pair of vertical rolls 1 are each supported in a bearing member 13 or 14. Both bearing members are placed on a carrying plate 15 so as to be slidable in V-shaped grooves 15*a* and can be fixed by means of clamping means 16. The carrying plate 15 is placed on a carrying box 17 which, together with the horizontal rolling mill stand 5, is carried by a base plate 18. The base plate 18, in turn, can be pulled in the direction of arrow A from a common foundation plate 19. Base plate 18 can be fixed relative to foundation plate 19 by means of clamping devices 20, as illustrated in FIGS. 1 and 4.

When pushing out the base plate 18 with the horizontal rolling mill stand 5 placed thereon and the bearing members 13, 14 with the vertical pair of rolls 1, the joint spindle 10 is separated from the angular gear unit 11, while the joint spindles 8 form the drive transmission to the horizontal rolling mill train 5 are separated from the intermediate gear unit 7. Supported by an attachment piece 18*a* of the base plate 18, the joint spindles 8 can be pulled with the base plate 18 and the units placed thereon out of the rolling line. The same is true for the angular gear unit 11 supported by base plate 18.

Figure 7:
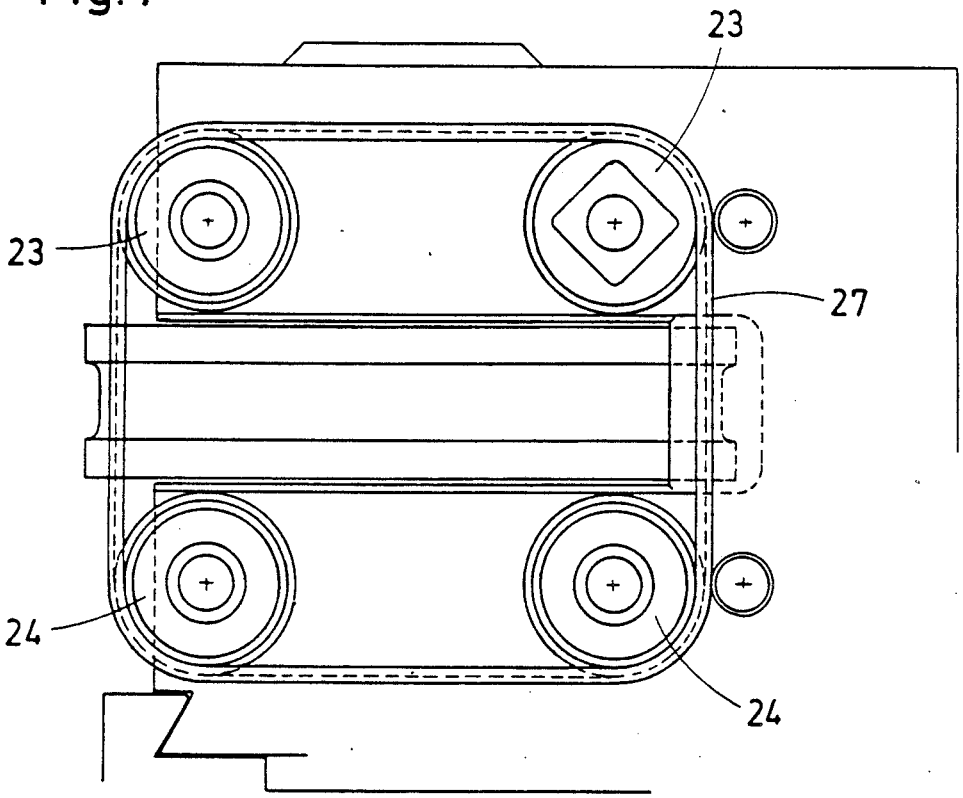
FIG. 7 is a side view of the detail shown in FIG. 5.

As illustrated in FIGS. 5 and 6, pairs of draw spindles 21 and 22 are guided above and below the vertical rolls 1 through the two bearing members 13, 14 of the vertical rolls 1. The draw spindles 21 and 22 have projecting threaded ends onto which toothed belt pinions 23, 24 are screwed, while ratchet wheels 25 are connected to the other ends of the spindles 21, 22. The ratchet wheels 25 are fixedly connected to the spindles and can be secured against rotation relative to the bearing members 13, 14 by means of locking rods 26. A toothed belt 27 is guided around each pinion 23, 24, as shown in FIG. 7. One of the pinions 23 is provided with a square adjusting piece 28.

The pinions 23 and 24 are supported in bearing plates 29 which, together with spacer disks 30, form a bearing housing which can be placed and pressed against the bearing member 14. An outwardly cantilevering hinge bolt 31 is attached to this bearing housing. The hinge bolt 31 is connected to a steering rod 32 which has a threaded bolt attachment 32*a*. This threaded bolt attachment 32*a* is longitudinally slidably guided in an annular member 33 which is rigidly connected through a holding plate 34 to the carrier plate 15. Adjusting nuts 35 are screwed onto the threaded bolt attachment on both sides of the annular member 33. A skirttype piston 36 and a replaceable stop member 37 are arranged above and below the vertical rolls 1 in oppositely located facing sides 13*a* and 14*a* of the bearing members 13, 14.

Figure 8:
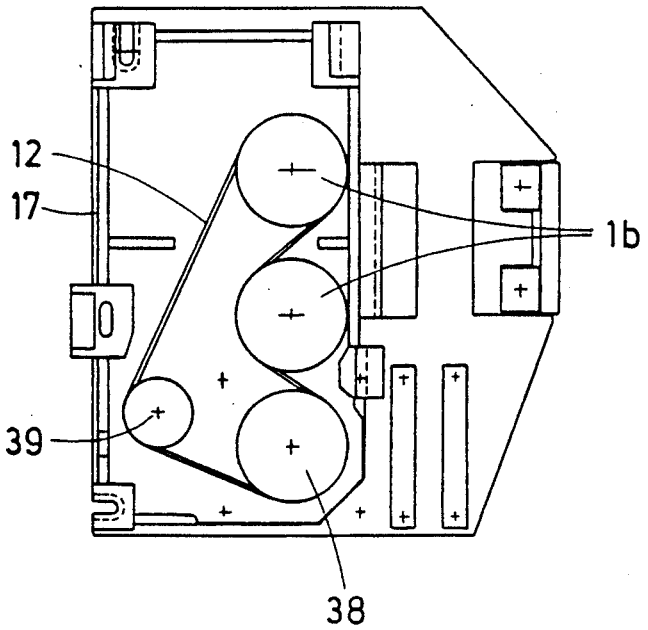
FIG. 8 is a partial sectional view along sectional line C—C of FIG. 4.

Toothed belt wheels 16 are mounted on downwardly facing axial projections 1*b* of vertical rolls 1 (compare FIGS. 8 and 2). The above-mentioned toothed belt 12 is placed on the wheels 16 forming a turnover loop. The toothed belt 12 is guided around a drive pinion 38 mounted on the angular gear unit 11 and a tensioning roller 39. As shown in FIG. 3, the axis 39*a* of the tensioning roller 39 is slidably and securably mounted in the carrying box 17 in an elastically supported guide 40.

After having been placed on the carrying plate 15, the two bearing members 13, 14 can be moved toward each other longitudinally slidably guided in the V-shaped groove 15*a* through the pinions 23 by turning the adjusting square 28 and transmitting this turning movement through the belt 27 onto all four pinions 23, 24 and applying a corresponding tension on the draw spindles 21, 22 wherein the skirt-type pistons 36 in one bearing member 14 rest against the stop members 37 in the other bearing member 13. Depending upon the size of the pass K to be adjusted between the two vertical rolls 1, a stop member 37 having the appropriate height must be selected.

After this coarse adjustment of the pass K, the fine adjustment is carried out. The fine adjustment is effected by applying a hydraulic pressure on the rear side of the skirt-type pistons 36, the pressure being approximately half the pressure which is necessary for tensioning the draw spindles 21, 22 up to the permissible value within the elastic range of these draw spindles.

After this fine adjustment of the pass K, the two bearing members 13, 14 are in the tensioned state aligned together by means of the steering rod 32 and the adjusting nuts 35 transversely of the line W of movement of the rolled material, so that the pass K is centered into the line W. Subsequently, the steering rod 32 is fixed relative to the annular member 33 by means of the adjusting nuts 35 and one of the two bearing members 13, 14, bearing member 13 in the illustrated example, is fixed on the carrying plate 15 by means of the clamping means 16.

The other bearing member 14 must remain transversely movable on the carrying plate 15 because the fine adjustment of the pass K is effected by controlled small pressure applications on the rear side of the skirt-type piston 36 against the tensioning pressure of the draw spindles 21, 22 within the elastic range thereof, so that the desired change in the width of the pass K is effected within very small steps of fractions of millimeters as is required for carrying out the operating method. This requires a corresponding transverse sliding of the bearing member 14.

The adjustment movements of both or one of the bearing members 13, 14 and of the vertical rolls 1 supported in the bearing members 13, 14 and of the wheels 1 being mounted on the axial projections 1*a* occurring with the above-described adjustment steps of the pass K are compensated on the drive side of the vertical rolls 1 by the toothed belt 12 in conjunction with the tensioning roller 39.

In addition to the above-described possibility of pulling the horizontal rolling mill stand 5 together with the vertical rolling arrangement composed of the bearing members 13, 14 and the vertical rolls 1 and the drive gear units 11, 38, 39, 1*b* and 12 together with the base plate 18 from the foundation plate 19, it is also possible to disassemble only the vertical rolling arrangement composed of carrying plate 15, bearing members 13, 14 with vertical rolls 1, toothed belt wheels 1*b* and tensioning roller 39 together with the carrying plate 15 by moving these members up; the toothed belt drive pinion 38 remains in the carrying box 17 together with the toothed belt 12. Thus, the carrying plate 15 is a type of changing plate by means of which a prepared second set of these components can be replaced against the first set.

While a specific embodiment of the invention has been shown and described in detail to illustrate the application of the inventive principles, it will be understood that the invention may be embodied otherwise without departing from such principles.

We claim:

1. In a rolling mill train for carrying out a method for continuously rolling a profiled billet to a predetermined finished cross-sectional shape of accurate dimension by means of at least two successively arranged rolling mill stands with pairs of rolls, wherein the axes of the pairs of rolls extend perpendicularly to each other, the pairs of rolls having oppositely located pass grooves which determine the cross-sectional shape of the rolled steel section billet which travels through the pairs of rolls, including means for sizing the billet in a roughing stand locally in a circumferential portion of the cross-section thereof which, after leaving the roughing stand, runs in a subsequent main stand into an area of a contact line of the two rolls of the main stand, such that the entire material of the billet running into the main stand completely fills out the pass of the main stand without significantly deforming the cross-sectional shape of the billet in the region of the contact lines of the two rolls of the main stand, wherein the geometric shape of the circumferential line of the passes formed in the roughing stand corresponds at least in the wall portion of the bottom of both pass grooves, and in the downstream main stand essentially in the entire wall portion of both pass grooves, with the geometric shape of the circumferential line of the predetermined infished cross-sectional shape of the billet, the improvement comprising the roughing stand being a sizing mill stand including pairs of rolls, means for positioning the rolls of the pairs of rolls of the sizing mill stand relative to each other with a preloading force which substantially exceeds the rolling force, wherein the distance between the centers of the bottom portions of the roughing stand is slightly smaller than or equal to the predetermined finished diameter of the cross-sectional shape formed in the pass, wherein the rolls of the pairs of rolls of the main stand have circumferential portions which are conventionally located laterally outside of the pass grooves, which portions rest on each other during rolling and which are pressed against each other with the preloading force, wherein the pass grooves have border edges which are rounded off, such that a slight laterally outwardly directed symmetrical recess is formed in the circumferential line of the pass, and wherein the wall portion of the bottom of the pass grooves of the roughing stand which coincides with the geometrical shape of the circumferential line of the predetermined finished cross-sectional line of the predetermined finished cross-sectional shape of the billet is dimensioned such that it covers the portion of the symmetrical recess of the circumferential line of the pass of the downstream sizing mill stand.

2. The rolling mill train according to claim 1, wherien the diameters of the rolls of the roughing stand and of the main stand are approximately equal.

3. The rolling mill train according to claim 2, wherein the diameter of the rolls of the pairs of rolls is approximately 250 mm or less.

4. The rolling mill train according to claim 3, wherein the distance between the common planes of the axes of the pair of rolls of the roughing stand and the pairs of the rolls of the main stand corresponds approximately to the sum of the diameter halves of both pairs of rolls.

5. The rolling mill train according to claim 1, wherein the roughing stand comprises a pair of vertical rolls, the vertical rolls being supported in bearing members which are connected to each other by means of adjustable draw spindles and which are supported against the tensioning force of the draw spindles by means of pistons to which pressure medium can be admitted and by replaceable stop members of different height which can be placed against the pistons, wherein the draw spindles have threaded ends, toothed belt pinions being guided on the threaded ends, a common toothed belt being guided around the pinions, and drive means for one of the pinions.

6. The rolling mill train according to claim 5, wherein the piston is a skirt-type piston mounted in a boretype recess of a side wall of each bearing member.

7. The rolling mill train according to claim 5, wherein the pair of vertical rolls forming the roughing pass and the horizontal rolling mill stand are releasably mounted on a common support means so as to be separable from the drive means therefor, and a foundation plate on which the support means is slidably and fixably mounted.

8. The rolling mill train according to claim 7, wherein the support means include a support box and a base plate.

9. The rolling mill train according to claim 8, wherein the bearing members with the vertical pair of rolls are arranged slidably and fixably on a support plate which is raisable from the support box.

10. The rolling mill train according to claim 5, wherein the rolls of a vertical pair of rolls have axial attachments which face downwardly, toothed belt wheels mounted on the attachments, the belt being placed around the wheels, the toothed belt further being placed in a reversing loop on a drive pinion and a tensioning roller.

11. The rolling mill train according to claim 10, wherein the drive pinion is mounted on the output side of an angular unit which is coupled to a drive motor, wherein the axis of the angular drive unit and the axis of the drive pinion are located in a common axial plane of the toothed belt wheels.

12. The rolling mill train according to claim 10, wherein the drive pinion is mounted on the output side of an angular unit which is coupled to a drive motor, wherein the axis of the angular drive unit and the axis of the drive pinion are located in a plane extending closely next to and parallel to a common axial plane of the toothed belt wheels.

* * * * *